US005938492A

United States Patent [19]

Carlini

[11] Patent Number: 5,938,492

[45] Date of Patent: Aug. 17, 1999

[54] REEL FOR SURFBOARD LEASH

[76] Inventor: Anthony J. Carlini, 5 Geneve, Newport Beach, Calif. 92660

[21] Appl. No.: 09/002,358

[22] Filed: Jan. 2, 1998

[51] Int. Cl.[6] ..... B63B 1/00

[52] U.S. Cl. ..... 441/75

[58] Field of Search ..... 242/375, 379, 242/379.2; 119/789, 770, 794, 796; 441/74, 75

[56] References Cited

U.S. PATENT DOCUMENTS

| | | | |
|---|---|---|---|
| 2,817,482 | 12/1957 | Ruggiero et al. | 242/379 |
| 3,012,736 | 12/1961 | Brust | 242/375 |
| 3,317,936 | 5/1967 | Johnson et al. | 242/379.2 |
| 4,621,589 | 11/1986 | Thinnes | 119/780 |
| 4,938,725 | 7/1990 | Beck | 441/75 |
| 5,490,805 | 2/1996 | Bredesen | 441/75 |

*Primary Examiner*—Stephen Avila
*Attorney, Agent, or Firm*—Roy A. Ekstrand

[57] ABSTRACT

An elongated flexible surfboard leash is secured at one end to a conventional plug attachment within a surfboard, wind-surf board or the like. The remaining end and a portion of the surfboard leash is wound within a housing having a take-up reel driven by a take-up spring. The housing is secured to the surfer's ankle and a slight tension is maintained upon the surfboard leash as the surfer moves about. An ankle strap includes conventional hook and loop fabric attachment for securing the housing to the user's ankle. In an alternate embodiment, an attachment cooperating with the leash plug of the board is secured thereto and further supports the take-up reel. The outer end of the surfboard leash is secured to an ankle strap formed of a flexible strap having hook and loop fabric attachment pads cooperating to secure the surf-board leash to the user's ankle.

10 Claims, 2 Drawing Sheets

10
18
41
40
55
51
56
57
58
60
61
67
68
62
63
64
65
66
69
39
13
33
70
71
50
16
17
72
73
74
51
56
57
59
55
58
67
20
15
14
80B
80
82
81
80A
36

REEL FOR SURFBOARD LEASH

FIELD OF THE INVENTION

This invention relates generally to water sport apparatus such as surfboards, windsurfing apparatus or other similar water sport activities and relates particularly to apparatus for securing the board leash used in such sports.

BACKGROUND OF THE INVENTION

Several extremely popular water sports such as windsurfing and surfboarding involve the participant's ability to stand upon the upper surface of a buoyant board such as a surfboard or windsurf board. Because of the possibility of the participant falling from the board in such high skill activities, it has become relatively common practice to secure the participant's ankle of the rearmost foot to the rear portion of the board using a flexible tether or leash. To provide such leash attachments, a variety of attachment mechanisms which cooperate with anchor-like devices embedded upon or otherwise secured to the board have been derived. Typically, an ankle attachment such as a flexible strap utilizing hook and loop fabric attachment pads are employed to secure one end of the leash to the participant.

In the highly precise and high skill activities of surfboarding as well as windsurfing, a substantial degree of care is taken to reduce or minimize the water friction or drag forces between the surfboard and the participant upon the water. Among high skill highly competitive surfers and windsurf, substantial concern is present as to drag or friction forces caused by the surfboard leash or tether being dragged through the water. Because such leashes tend to come in fixed predetermined lengths, the leash often forms a substantially extended loose loop of flexible material which trails in the water and produces a significant drag. To exacerbate the situation further, as the surfer or windsurfer moves about on the upper surface of the board to balance and drive the board through the water, the effective length and drag of this leash changes. If the surfer moves rearward on the board, the loop of leash material gets longer. Conversely, when the surfer moves forward on the board, the length of leash material forming the dragging loop is decreased.

Thus, while the presently available devices for securing and maintaining surfboard leashes have provided a measure of safety and effectiveness, there remains a continuing need in the art for more effective, efficient and reliable systems for securing surfboard leashes.

SUMMARY OF THE INVENTION

Accordingly, it is a general object of the present invention to provide an improved apparatus for securing and maintaining a surfboard leash for surfboards, windsurfing board, and similar apparatus. It is a more particular object of the present invention to provide an improved retaining apparatus for surfboard leashes and the like which minimizes the drag imposed upon the surfer moving through the water.

In accordance with the present invention, there is provided a leash reel for use in combination with a water sport board having a leash plug attachment, the leash reel comprising: a housing having an interior cavity and leash aperture formed therein; a take-up reel rotatably supported within the housing interior cavity; a flexible leash having an interior end secured to the take-up reel, a portion wound upon the take-up reel and an outer portion passing through the leash aperture and having an outer end coupled to the leash plug attachment of a water sport board; a take-up spring coupled to the take-up reel urging the take-up reel toward rotation winding the leash upon the take-up reel; and attachment means for securing the housing to the leg of a user.

The invention also provides a leash reel for use in combination with a water sport board having a leash plug attachment, the leash reel comprising: a housing having an interior cavity and leash aperture formed therein; a housing plug attachment for securing the housing to the leash plug attachment; a take-up reel rotatably supported within the housing interior cavity; an ankle attachment secured to the leg of a user; a flexible leash having an interior end secured to the take-up reel, a portion wound upon the take-up reel and an outer portion passing through the leash aperture and having an outer end coupled to the ankle attachment; and a take-up spring coupled to the take-up reel urging the take-up reel toward rotation winding the leash upon the take-up reel.

In a more general sense, the invention provides a leash reel for use in combination with a water sport board having a leash plug attachment therein, the leash reel comprising: a housing defining a leash aperture and an interior cavity; a take-up reel rotatably supported within the housing interior cavity; a take-up spring coupled to the take-up reel; an ankle attachment secured to the ankle of a user; means for attachment to the leash plug attachment of a water sport board; and a leash having an interior and joined to the take-up reel, a portion of leash wound upon the take-up reel and an outer end passing through the leash aperture of the housing, the housing and the outer end of the leash being coupled between the means for attachment and the ankle attachment whereby the leash is maintained in tension between the ankle attachment and the leash plug attachment of the water sport board despite user movement.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
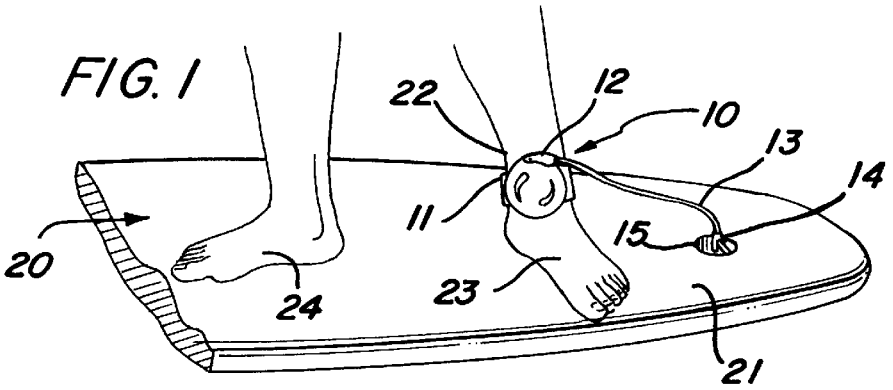
FIG. 1 sets forth a partial perspective view of a typical surfboard and the present invention reel for surfboard leash.

FIG. 1 sets forth a partial perspective view of a conventional surfboard generally referenced by numeral 20 having an upper surface 21 and a conventional leash plug 15. In the perspective view of FIG. 1, the ankles and feet of a surfer or windsurfer are shown having feet 23 and 24 positioned upon upper surface 21 as they would be during surfing activity.

In accordance with the present invention, a reel 10 includes a housing 12 secured to ankle 22 above foot 23 by a flexible strap 11 in the manner shown in FIG. 5 below. In further accordance with the present invention, a flexible surfboard leash 13 is wound upon an internal take-up reel (seen in FIG. 6) and extends outwardly from housing 12. The outermost end of leash 13 supports a plug attachment mechanism 14 which may be fabricated entirely in accordance with conventional fabrication techniques and is configured to be releasibly secured to leash plug 15 of surfboard 20. In further accordance with the present invention, leash 13 is maintained in a slight degree of tension and thus is drawn in a relatively straight path from leash plug 15 to housing 12. In further accordance with the present invention and as is set forth below in greater detail, the structure of reel 10 maintains tension upon leash 13 and accommodates the movement of foot 23 upon surfboard 20 by allowing a greater or lesser amount of leash 13 to be pulled from or wound into housing 12. Thus, as the surfer upon a surfboard or windsurfer upon a windsurfing board moves around upon the upper surface, leash 13 is maintained in slight tension and accommodates the extent of movement to maintain leash 13 above upper surface 21 and prevent leash 13 from dragging in the water as it moves past the hoard.

Figure 2:
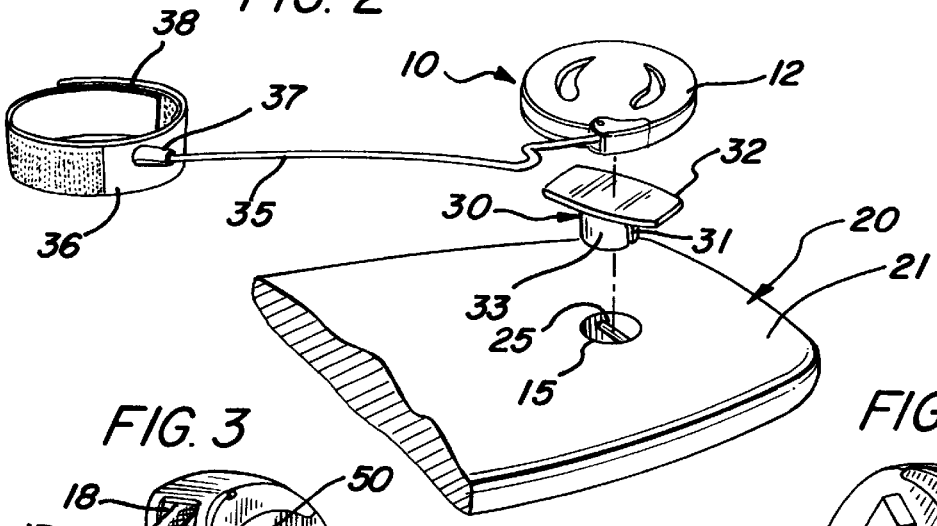
FIG. 2 sets forth a partial perspective view of a conventional surfboard and an alternate embodiment of the present invention reel for surfboard leash.

FIG. 2 sets forth a partial perspective assembly view of an alternate embodiment of the present invention in which reel 10 is secured at the surfboard end of a flexible surfboard leash 35 while an ankle strap 36 secures the remaining end to the surfer's ankle. Thus, in essence, the alternate embodiment of FIG. 2 "reverses" the operating position of the present invention surfboard reel. In the embodiment of FIG. 2, a conventional leash plug 15 is formed within board 20 and, in further accordance with conventional fabrication techniques, includes a transversely extending anchor pin 25. An attachment 30 includes a relatively flexible planar flex plate 32 supported by a cylindrical attachment plug 33. Plug 33 defines a notch 31 configured to receive and releasibly secure attachment 32, plug anchor pin 25 retaining plug 33 within leash plug 15. As is better seen in FIG. 4, housing 12 defines a pair of strap loops 40 and 41 on the rear surface thereof. Returning to FIG. 2, housing 12 is secured to flex plate 32 by bending and inserting flex plate 32 through strap loops 40 and 41. In this manner, housing 12 is secured to surfboard 20 in a releasible attachment.

In further accordance with the present invention, flexible surfboard leash 35 is wound within housing 12 on a tension take-up reel. The outer end of leash 35 is secured to ankle strap 36 by a conventional connector 37. Ankle strap 36 further includes conventional attachment pads such as the well known hook and loop fabric pads for securing ankle strap 36 to the surfer's ankle and accommodating ankle size adjustment.

In the anticipated use of the embodiment of the present invention shown in FIG. 2, the user secures ankle strap 36 to one ankle, most typically the rearmost ankle, and thereafter moves about the upper surface of surfboard 20 to maintain balance and control the board attitude within the water. As with the embodiment set forth above in FIG. 1, the function of reel 10 is the maintenance of a slight tension upon leash 35 to avoid dragging the surf leash through the water and accommodate the movement of the user upon the board surface.

Figure 3:
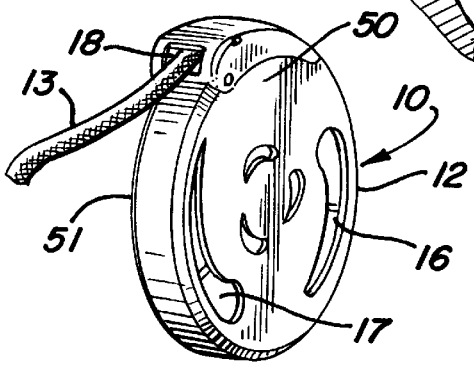
FIG. 3 sets forth a perspective view of the present invention reel for surfboard leash.

FIG. 3 sets forth a front perspective view of reel 10 showing surfboard leash 13 extending therefrom. As described above, reel 10 includes a housing 12 which is preferably formed of a pair of molded plastic housing portions fitted to define a housing enclosure. In the embodiment of FIG. 3, housing 12 is formed of a front housing portion 50 and a rear housing portion 51. Portions 50 and 51 may be secured using conventional adhesive attachment or other processes such as chemical or sonic welding or the like. Housing 12 defines a leash aperture 18 through which leash 13 passes together with a plurality of water flow apertures 16 and 17 formed in front portion 50. The function of apertures 16 and 17 is the provision of water flow for self-cleaning and lubrication of the mechanism within reel 10. Thus, as leash 13 is drawn from or wound within housing 12 by the take-up mechanism described below, water flow through apertures 16 and 17 maintains lubrication and cleansing of the apparatus.

Figure 4:
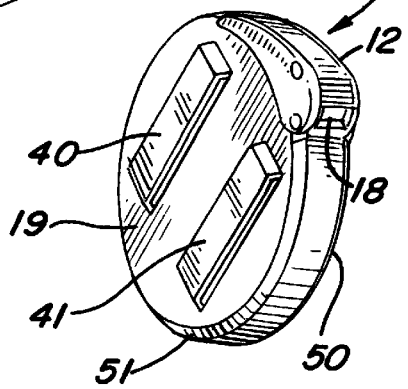
FIG. 4 sets forth a rear perspective view of the present invention reel for surfboard leash.

FIG. 4 sets forth a rear perspective view of the present invention reel for surfboard leash. Of importance to note in FIG. 4 is the provision of a rear surface 19 upon rear portion 51 of housing 12 which supports a pair of strap loops 40 and 41. Strap loops 40 and 41 extend from rear surface 19 and facilitate the passage of ankle strap 11 therethrough to provide the attachment of reel 10 to the user's ankle as described above in FIG. 1 and as is set forth below in FIG. 5 in greater detail.

Figure 5:
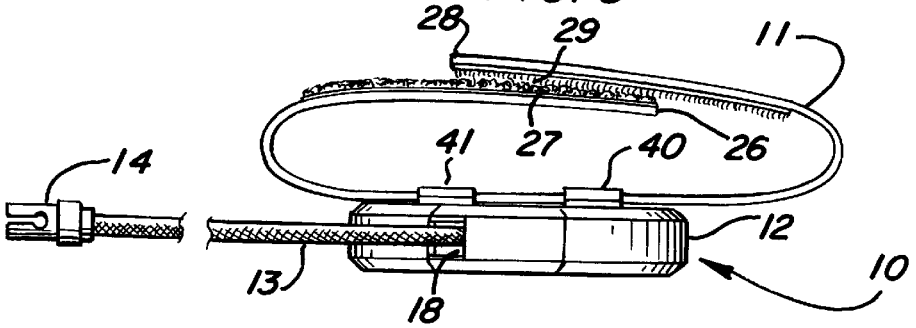
FIG. 5 sets forth a top view of the present invention reel for surfboard leash.

FIG. 5 sets forth a top view of the present invention reel for surfboard leash supported by a flexible ankle strap. More specifically, FIG. 5 shows surfboard leash reel 10. As described above, reel 10 includes a housing 12 defining an aperture 18 through which leash 13 passes. As is also described above, leash 13 supports a plug attachment 14 at its outer end. Plug attachment 14 may be constructed in accordance with conventional fabrication techniques and functions solely to secure the outer end of leash 13 to the cooperating plug such as leash plug 15 shown in FIG. 1 of surfboard 20. As is also described above, housing 12 supports a pair of strap loops 40 and 41 on the rear surface thereof. Strap loops 40 and 41 receive an ankle strap 12 formed of a flexible strap material which passes through strap loops 40 and 41. Strap 11 defines ends 26 and 28 together with a pair of cooperating inwardly facing hook and loop fabric attachment pads 27 and 29. The function of pads 27 and 29 is the provision of an adjustable attachment for looping strap 11 about the user's ankle.

Figures 6, 7, 8:
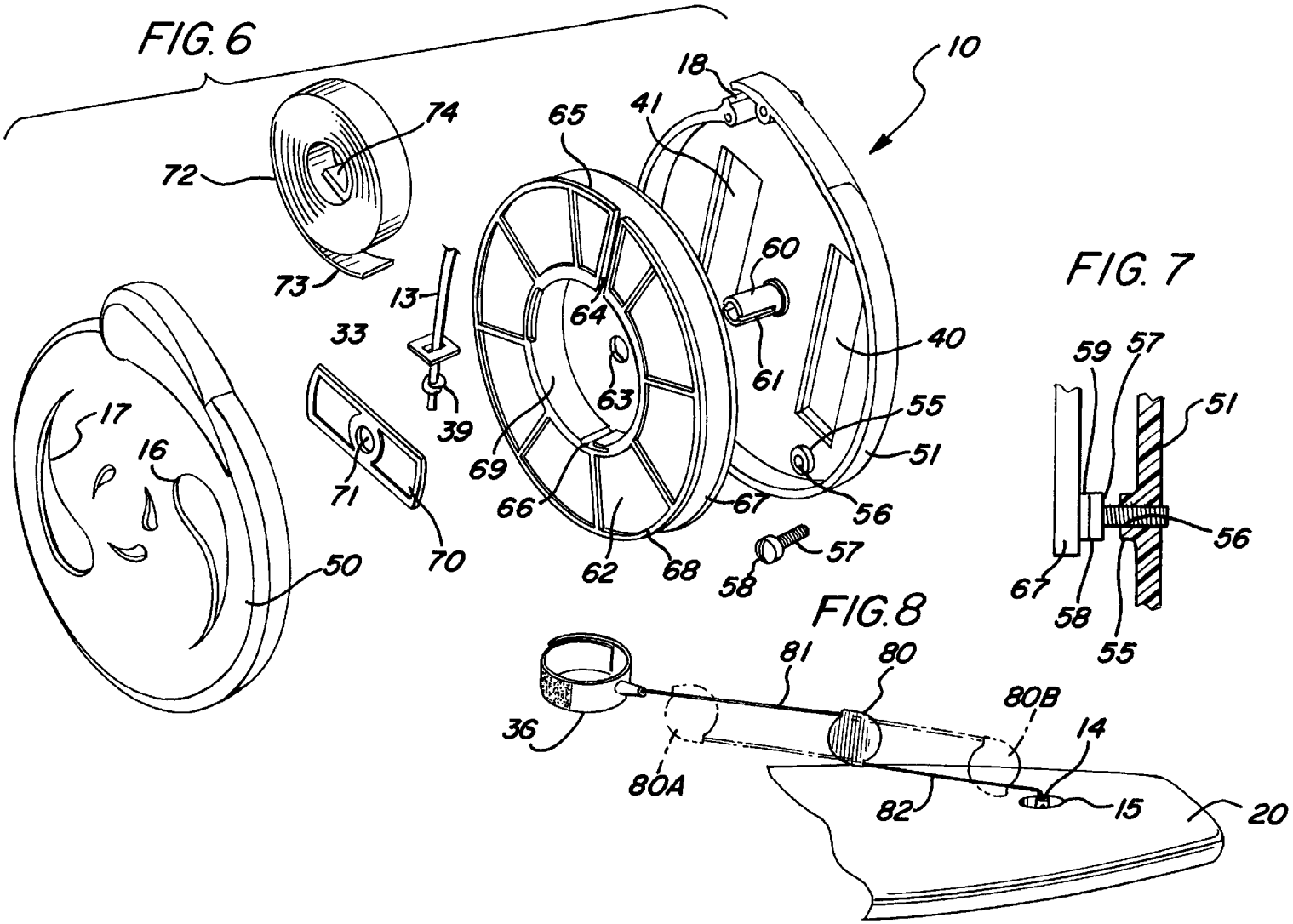
FIG. 6 sets forth a perspective assembly view of the present invention reel for surfboard leash.
FIG. 7 sets forth a partial section view of the tension adjustment mechanism within the present invention reel for surfboard leash.
FIG. 8 sets forth a perspective view of a still further alternate embodiment of the present invention reel for surfboard leash.

FIG. 6 sets forth a perspective assembly view of the present invention reel for surfboard leash. Reel 10 includes a housing 12 formed of a front portion 50 and a rear portion 51 which mate to form an enclosure. Front portion 50 defines a pair of water flow apertures 16 and 17 and is secured to rear portion 51 using conventional adhesive attachment or other equivalent attachment systems. Rear portion 51 defines a pair of strap loops 40 and 41 together with an inwardly extending spring post 60. The latter defines a slot 61 extending therethrough. Housing portion 51 further defines a boss 55 extending inwardly which defines a threaded aperture 56. An adjustment screw 57 having a cooperating thread for being threadably received within aperture 56 further includes a head 58. Screw 57 is assembled within boss 55 as seen in FIG. 7.

Reel 10 further includes a take-up reel 62 having spaced apart walls 67 and 68 extending from a recessed portion 69. Wall 68 further defines an aperture 63 which allows take-up reel 62 to be rotatably supported upon post 60. A spring end retaining slot 66 is formed in the lower portion of recess 69 and a gap 64 is formed in wall 68. The latter is provided to facilitate the passage of the interior end of leash 13. Thus, leash 13 is passed through gap 64 and is secured within recess 69 by a knot 38 formed therein together with a cooperating lock 33.

Thus, in accordance with the present invention, the interior end of leash 13 extends through gap 64 and is captivated within recess 69 while the remaining portion of leash 13 is wound within channel 65 of take-up reel 62 between walls 67 and 68. The outer portion of leash 13 extends outwardly through aperture 18 formed between housing portions 50 and 51.

Take-up reel 62 being rotatably received upon post 60 and leash 13 being captivated at its interior end by knot 39 and wound about reel 62, a coil spring 72 of the type often referred to in the art as a "clock spring" is inserted into recess 69 such that interior end 74 of spring 72 is received within slot 61 while outer end 73 of spring 72 is received within slot 66 of take-up reel 62. The resulting assembly provides a spring tension force upon take-up reel 62 as leash 13 is drawn outwardly to create tension in spring 72 which urges the take-up or winding of leash 13.

A retainer 70 defining an aperture 71 is received upon post 60 and functions to captivate spring 72 within recess 69 as front housing portion 50 is assembled to rear housing portion 51.

The completed structure provides a take-up reel mechanism operative to draw leash 13 into the housing for winding upon take-up reel 62. As the leash is drawn outwardly, tension is wound into spring 72 producing a corresponding rewinding or take-up tension upon leash 13. The extent of the tension applied to leash 13 is controlled by the position of adjustment screw 57 against wall 67 of take-up reel 62.

FIG. 7 shows a partial section view of the adjustment of screw 57 for controlling the tension applied to leash 13. As described above, rear housing portion 51 defines a boss 55 having a threaded aperture 56 formed therein. An adjustment screw 57 is threaded into aperture 56 such that head 58 thereof is aligned with the outer portion of wall 67 of take-up reel 62 (the latter seen in FIG. 6). Head 58 is brought into contact with wall 67 by threading screw 57 inwardly using a conventional set screw or conventional screwdriver to rotate screw 57. The friction between head 58 and wall 67 provides control of the tension exerted by spring 72 upon leash 13 (seen in FIG. 6). In its preferred fabrication, head 58 further supports a layer of friction producing material which provides a more controllable friction between head 58 and wall 67 and which prevents undue wear upon wall 67.

FIG. 8 shows a still further embodiment of the present invention in which a take-up reel 80 is positioned between an ankle strap 36 and a plug attachment 14. A leash 31 extends from one side of reel 80 while a leash 82 extends from the other side of reel 80. Reel 80 is a conventional double-sided reel which maintains leashes 81 and 82 in tension between strap 36 and leash plug 15. Reel 80 may be positioned closer to strap 36 as shown by dashed line reel 80A or closer to attachment 14 as shown by dashed line reel 80B.

What has been shown is a reel for surfboard Leash which may be used by surfers and windsurfers as well as other participants in similar sport activities to maintain a light take-up tension upon the surfer's leash and prevent the loose surf leash from dragging through the water as the board moves and the surfer moves about. The surfboard leash reel shown is readily formed of low cost molded plastic components for the most part and utilizes a water flow through process for producing a self-cleaning and self-lubricating character for the surfboard leash reel.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A leash reel for use in combination with a water sport board having a leash plug attachment, said leash reel comprising:

a housing having an interior cavity and leash aperture formed therein;

a take-up reel rotatably supported within said housing interior cavity;

a flexible leash having an interior end secured to said take-up reel, a portion wound upon said take-up real and an outer portion passing through said leash aperture and having an outer end coupled to the leash plug attachment of a water sport board;

a take-up spring coupled to said take-up reel urging said take-up reel toward rotation winding said leash upon said take-up reel to provide spring tension of said leash regardless of the user's position relative to said leash plug attachment; and attachment means for securing said housing to the leg of a user such that said housing is secured against the user's leg and said leash extends from said housing to said leash plug attachment.

2. The leash reel set forth in claim 1 wherein said attachment means include:

a flexible strap having first and second ends;

means for joining said first and second ends to encircle the leg of a user; and means for attaching said strap to said housing and for cooperating with said means for joining to secure said housing against the user's leg.

3. The leash reel set forth in claim 2 further including tension adjustment means for controlling the urging of said take-up spring upon said take-up reel.

4. The leash reel set forth in claim 3 wherein said tension adjustment means includes:

a threaded aperture formed in said housing; and a threaded adjustment screw received within said threaded aperture and defining a head forced against said take-up reel.

5. The leash reel set forth in claim 4 wherein said take-up reel defines a center recess and wherein said take-up spring includes a clock spring having one end coupled to said housing and another end coupled to said take-up reel.

6. The leash reel set forth in claim 5 wherein said housing defines a plurality of water flow apertures into said interior cavity.

7. The leash reel set forth in claim 2 wherein said housing defines a plurality of water flow apertures into said interior cavity.

8. The leash reel set forth in claim 2 further including tension adjustment means for controlling the urging of said take-up spring upon said take-up reel.

9. The leash reel set forth in claim 8 wherein said tension adjustment means includes:

a threaded aperture formed in said housing; and a threaded adjustment screw received within said threaded aperture and defining a head forced against said take-up reel.

10. The leash reel set forth in claim 9 wherein said attachment means include:

a flexible strap having first and second ends;

means for joining said first and second ends to encircle the leg of a user; and means for attaching said strap to said housing.

* * * * *